United States Patent [19]

Neroznikov et al.

[11] Patent Number: 5,064,003

[45] Date of Patent: Nov. 12, 1991

[54] HYDRAULIC DRILLING MACHINE

[76] Inventors: Jury I. Neroznikov, ulitsa 40 let Kazakhstana, 40, kv. 41, Karaganda; Nikolai N. Shvets, ulitsa 8 Marta, 47, kv. 62, Dnepropetrovskaya oblast, Zheltye Vody; Ivan P. Rudakov, ulitsa Gogolya, 47, kv. 57, Karaganda; Andrei I. Shevchenko, ulitsa Franko, 32, kv. 56, Dnepropetrovskaya oblast, Zheltye Vody; Valentin N. Fanshtein, Stepnogors, 1 mikroraion, 63, kv. 10, Tselinogradskaya oblast; Vladimir A. Medyanik, ulitsa Shevchenko, 17, kv. 51, Dnepropetrovskaya oblast, Zheltye Vody; Nikolai A. Mushtakov, ulitsa Erzhanova, 43, kv. 44, Karaganda, all of U.S.S.R.

[21] Appl. No.: 449,873

[22] PCT Filed: Apr. 11, 1989

[86] PCT No.: PCT/SU89/00090

§ 371 Date: Dec. 26, 1989

§ 102(e) Date: Dec. 26, 1989

[87] PCT Pub. No.: WO89/10465

PCT Pub. Date: Nov. 2, 1989

[30] Foreign Application Priority Data

Apr. 26, 1988 [SU] U.S.S.R. ..... 4416113
Jul. 20, 1988 [SU] U.S.S.R. ..... 4464093

[51] Int. Cl.[5] ..... B23B 45/16

[52] U.S. Cl. ..... 173/106; 173/105; 173/104; 173/1

[58] Field of Search ..... 173/112, 114, 134, 135, 173/138, 1, 104, 105, 106

[56] References Cited

U.S. PATENT DOCUMENTS

| | | | |
|---|---|---|---|
| 3,561,542 | 2/1971 | Hanson et al. | 173/112 X |
| 3,669,197 | 6/1972 | Hanson . | |
| 4,261,249 | 4/1981 | Grantmyre | 173/138 X |

FOREIGN PATENT DOCUMENTS

| | | |
|---|---|---|
| 0168382 | 3/1986 | European Pat. Off. . |
| 0203282 | 3/1986 | European Pat. Off. . |
| 1073450 | 2/1984 | U.S.S.R. . |
| 1181557 | 9/1985 | U.S.S.R. . |
| 1222832 | 3/1986 | U.S.S.R. . |
| 1435776 | 11/1988 | U.S.S.R. . |

*Primary Examiner*—Timothy V. Eley
*Assistant Examiner*—Willmon Fridie, Jr.
*Attorney, Agent, or Firm*—Lilling & Lilling

[57] ABSTRACT

A hydraulic drilling machine has a drilling tool connected to a hydraulic motor, a hydraulic percussive mechanism connected through a rotatable fluid distributor to pressure and discharge lines, and a flow governor made up of a non-return valve and a flow throttling valve connected in parallel. The inlet of the flow governor is connected to a discharge line of the hydraulic motor, whereas its outlet is connected to a discharge line of the hydraulic percussive mechanism in the form of a hydraulic reaction turbine.

2 Claims, 2 Drawing Sheets

HYDRAULIC DRILLING MACHINE

BACKGROUND OF THE INVENTION

1. Field of the Invention

This invention relates generally to equipment associated with operation of mines and quarries and, more particularly, to a hydraulic drilling machine.

2. Description of the Related Art

There is known a hydraulic drilling machine (cf., SU, A, 1,073,450) comprising a drill tool, a hydraulic motor for rotating the drill tool connected thereto through a reduction gear and having hydraulic pressure and discharge lines, and a hydraulic percussive mechanism having pressure and discharge lines communicating therewith via a rotatable fluid distributor, and a drive for rotating the fluid distributor. The hydraulic motor is used as a drive for rotating the fluid distributor in this hydraulic drilling machine. A separate hydraulic pressure line is used to feed the hydraulic motor rotating the fluid distributor.

In order to smoothly control the frequency and power of percussive action, use is made of a slide valve connected to the pressure lines of the hydraulic percussive mechanism and to the hydraulic motor rotating the drill tool.

The use of a hydraulic motor as the drive for rotating the fluid distributor necessitates extra consumption of liquid under pressure, and, accordingly, requires an additional pump.

As the slide valve is connected to the pressure lines the hydraulic motor rotating the drill tool and to hydraulic percussive mechanism, controlling the slide valve likewise necessitates more liquid under high pressure.

In addition, the above facilities fail to control the frequency and power of impacts delivered by the hammer of the percussive mechanism when reversing the hydraulic motor rotating the drill tool.

The aforedescribed overcomplicates the drilling machine in terms of its construction and control, as well as affects its reliability and reduces its operation efficiency.

SUMMARY OF THE INVENTION

The present invention aims at providing a hydraulic drilling machine in which a drill tool and percussive mechanism would be so hydraulically controlled as to ensure a higher efficiency of its hydraulic system, while simultaneously providing variations in the frequency of percussive action during changing of the rotation or stopping of rotational movement of the drill tool, as well as to improve the reliability of the machine.

The aim of the invention is attained by a hydraulic drilling machine comprising a drill tool, a hydraulic motor for rotating the drill tool connected to the drill tool through a reduction gear and having hydraulic pressure and discharge lines, and a hydraulic percussive mechanism having pressure and discharge lines connected to the arrangement through a rotatable fluid distributor, and a drive for rotating the fluid distributor. According the invention, the machine includes a flow governor made up of a non-return valve and a flow throttling valve connected in parallel, the inlet of the flow governor being connected to the discharge line of the hydraulic motor for rotating the drill tool through a fluid distributor provided in this line, and to the discharge line of the hydraulic motor through a flow restrictor, whereas the outlet of the flow governor is connected to the discharge line of the hydraulic percussive mechanism and to the inlet of the drive for rotating the fluid distributor having the form of a hydraulic turbine, a hydraulic accumulator being provided in the discharge line of the hydraulic percussive arrangement.

Preferably, the hydraulic turbine is a reaction turbine secured at the rotating element of the fluid distributor, the working chamber of the hydraulic turbine being preferably communicated with a discharge cavity of a rotatable fluid distributor via axial passages made in the fluid distributor, the discharge cavity of the rotatable fluid distributor continuously communicating with the hydraulic accumulator.

In view of the aforedisclosed, it is possible, because the hydraulic turbine uses a joint flow of the liquid spent in the hydraulic percussive arrangement and in the hydraulic motor rotating the drill tool, and because of the provision of a flow governor and a hydraulic accumulator, to attain a higher operation efficiency, ensure a guaranteed starting of the hydraulic turbine, and expand functional capabilities of the hydraulic system.

The use of a hydraulic reaction turbine as the drive for rotating the fluid distributor allows simplification of construction, reduction in weight and size, and improvement of reliability of the drilling machine.

Making use of the joint flow of liquid spent in the hydraulic motor for rotating the drill tool and hydraulic percussive mechanism affords an increase in the efficiency and a reduction in the rate of high pressure liquid consumed, as well as simplifies the pumping station by dispensing with a pump for feeding the hydraulic motor for rotating the fluid distributor to result in a smaller mass and size of the pumping station.

Connecting the flow governor to the discharge line of the hydraulic motor for rotating the drill tool via a fluid distributor ensures that the rotational speed of the hydraulic turbine can be controlled regardless of the direction of rotation of the drill tool or stops of the drill tool.

A hydraulic accumulator provided in the discharge line of the hydraulic percussive arrangement maintains the speed of rotation of the hydraulic turbine in the course of the work stroke of the hammer of the hydraulic percussive mechanism.

A non-return valve built into the hydraulic system facilitates conveying the entire flow of spent liquid from the hydraulic percussive mechanism to the hydraulic turbine.

BRIEF DESCRIPTION OF THE DRAWINGS

The invention will now be described in greater detail with reference to a specific embodiment thereof taken in conjunction with the accompanying drawings, in which.

DESCRIPTION OF THE PREFERRED EMBODIMENT

Figure 1:
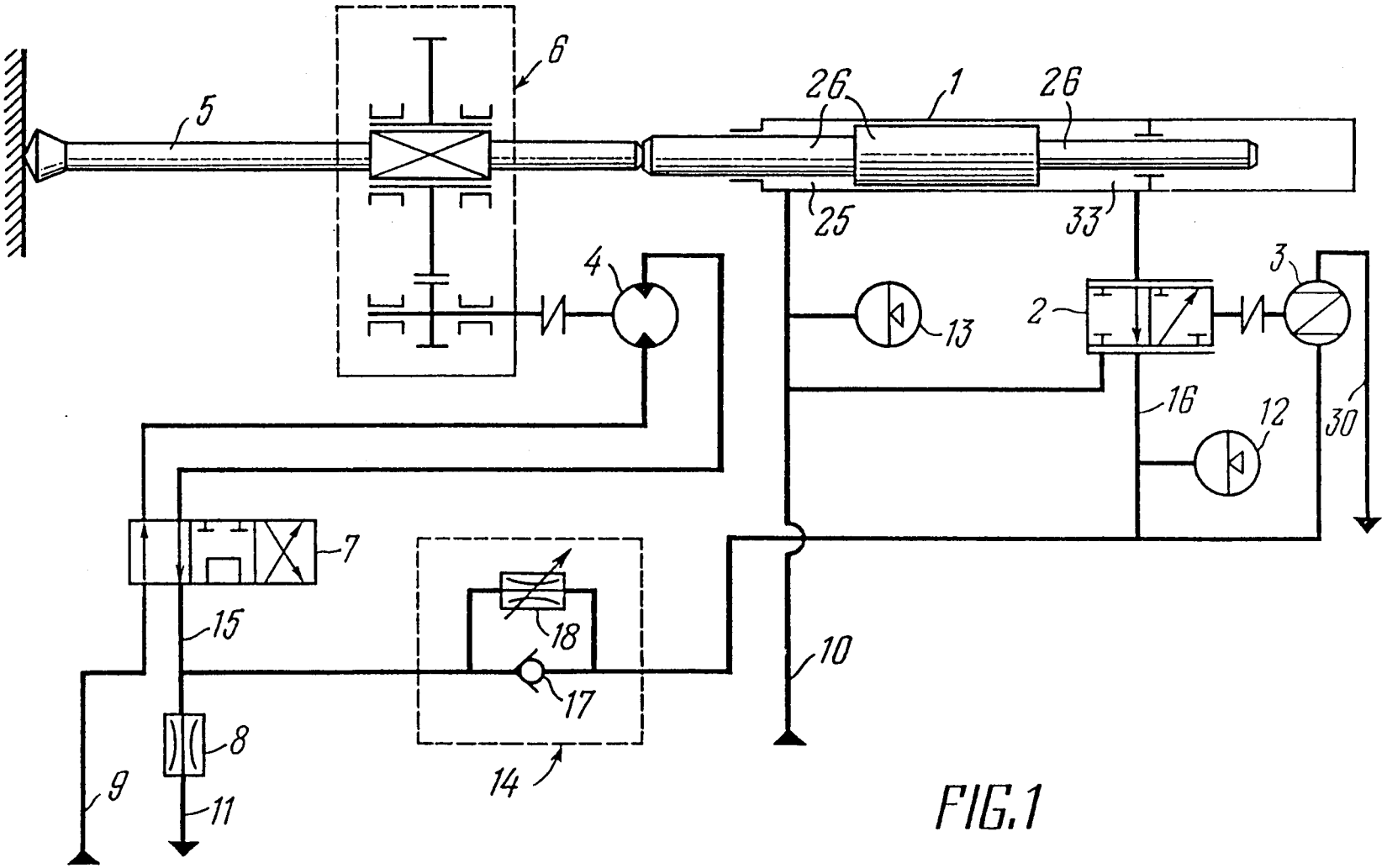
FIG. 1 is a schematic representation of a hydraulic drilling machine, according to the invention.

A hydraulic drilling machine, according to the invention, comprises a hydraulic percussive mechanism (FIG. 1), a rotary fluid distributor 2, a drive for rotating the fluid distributor 2 in the form of a hydraulic turbine 3, a hydraulic motor 4, a drill tool 5, a reduction gear 6 transmitting rotation from the hydraulic motor 4 to the drill tool 5, a three position distribution valve 7, a flow restrictor 8, hydraulic pressure lines 9 and 10 of the hydraulic motor 4 for rotating the drill tool 5 and hydraulic percussive mechanism 1, respectively, a discharge line 11 of the hydraulic motor 4, accumulators 12 and 13, such as hydraulic accumulators, a flow governor 14, a discharge line 15 of the hydraulic motor 4, and a discharge line 16 of the hydraulic percussive mechanism 1.

The flow governor 14 includes a non-return valve 17 and a flow throttling valve 18 connected in parallel. The direction of rotation of the drill tool 5 is changed by turning the three position distribution valve 7. The hydraulic motor 4 for rotating the drill tool 5 and the hydraulic percussive mechanism 1 are fed from the hydraulic pressure lines 9 and 10, respectively. The hydraulic turbine 2 is fed by a joint flow of the spent liquid from the hydraulic percussive mechanism 1 and hydraulic motor 4 for rotating the drill tool. The inlet of the flow governor 14 is connected to the discharge line 15 of the hydraulic motor 4 through the three position valve 7 built thereinto, and to the discharge line 11 of the hydraulic motor 4 via the flow restrictor 8. The outlet of the flow governor 14 is connected to the discharge line 16 of the hydraulic percussive mechanism 1 and to the inlet of the drive for rotating the percussive mechanism 1, viz., to the hydraulic turbine 3.

The hydraulic accumulator 12 is built into the discharge line 16 of the percussive mechanism 1, whereas the hydraulic accumulator 13 is mounted in the pressure line 10. The hydraulic pressure line 10 and discharge line 16 are connected to the corresponding chambers of the percussive mechanism 1 via the rotary fluid distributor 2.

According to one preferred embodiment of the present invention, a reaction turbine 19 is used as the hydraulic turbine for rotating the fluid distributor 2. The reaction turbine 19 has its shaft secured at a rotating element 20 of the fluid distributor 2, and its working chamber 21 communicates with an annular discharge cavity 22 of the fluid distributor 2 via axial passages 23 provided therein. The annular discharge cavity 22 of the fluid distributor continuously communicates with the hydraulic accumulator 12. An annular pressure cavity 24 of the fluid distributor 2 is connected to a return stroke chamber 25 of a hammer 26 of the percussive mechanism 1.

Figure 3:
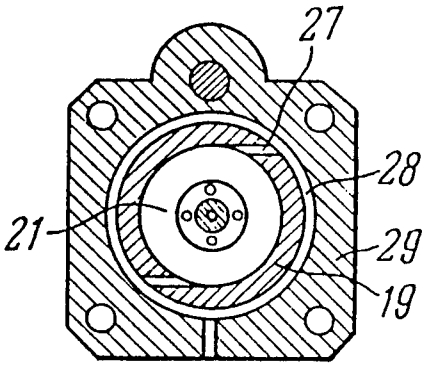
FIG. 3 is a section taken along the line III—III in FIG. 2.
Figure 2:
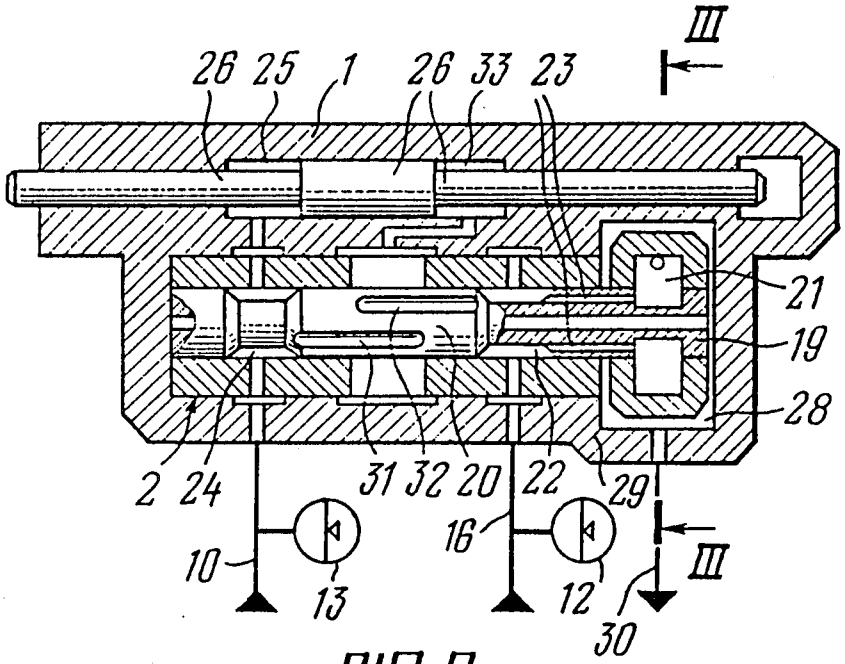
FIG. 2 is a longitudinal sectional view of a modified form of a drive for rotating the flow distributor.

The working chamber 21 of the reaction turbine 19 communicates through tangential holes 27 (FIG. 3) and interior 28 of a casing 29 with a discharge line 30 (FIGS. 2 and 1).

The rotating element 20 (FIG. 2) of the hydraulic fluid distributor 2 has longitudinal grooves 31 and 32 connected to the annular pressure and discharge cavities 24 and 22. The work stroke chamber 33 of the hammer of the hydraulic percussive mechanism 1 communicates through the longitudinal grooves 31 and 32 with the pressure or discharge cavities 24, 22.

The proposed hydraulic drilling machine operates as follows. The operation cycle of the machine is controlled by feeding the working liquid along the pressure lines 9 (FIG. 1) and 10 to the hydraulic motor 4 for rotating the drill tool 5 and to the hydraulic percussive mechanism 1, respectively. The three position valve 7 serves to stop and reverse rotation of the drill tool 5. The spent liquid flows from the hydraulic motor 4 to the three position valve 7, and then is divided into two parallel flows of which one is conveyed through the flow restrictor 8 to the hydraulic discharge line 11, whereas the other is conveyed through the flow governor 14 to join with the discharge of the hydraulic percussive mechanism 1 and accumulator 12 and be directed to the hydraulic turbine 3. The flow restrictor 8 of the discharge line 11 provides a pressure difference sufficient for opening the non-return valve 17, whereby the main part of the liquid from the hydraulic motor 4 for rotating the drill tool 5 will flow to the hydraulic turbine 3, and the rest of the liquid will pass through the flow restrictor 8 to the discharge line 11. The liquid that enters the hydraulic turbine 3 actuates this turbine. The hydraulic turbine 3 starts to rotate the fluid distributor 2 at a low speed. The rotating fluid distributor 2 will communicate the work stroke chamber 33 of the hammer 26 of the hydraulic percussive mechanism 1 alternately with the pressure line 10 and with the discharge line 16. Communication of the work stroke chamber 33 of the hydraulic percussive mechanism 1 with the discharge line 16 through the fluid distributor 2 causes a reverse stroke of the hammer 26, as the return stroke chamber 25 of the hammer continuously communicates with the pressure line 10. At the same time, the liquid is forced by the hammer 26 from the work stroke chamber 33 to the hydraulic accumulator 12, hydraulic turbine 3 and flow governor 14. The liquid conveyed from the hydraulic percussive mechanism 1 to the non-return valve 17 acts to close it. Then the entire flow of spent liquid will charge the hydraulic accumulator 12 and rush to the hydraulic turbine 3 which will act to substantially increase the rotational speed of the fluid distributor 2. As the hydraulic fluid distributor 2 communicates the work stroke chamber 33 with the pressure line 10, the hammer 26 executes a work stroke and delivers an impact on the drill tool 5. The work stroke of the hammer 26 takes place thanks to a difference in the cross sections of the hammer 26 in the return and work stroke chambers. Concurrently, the accumulator 12 in the discharge line 16 of the hydraulic percussive mechanism tends to discharge and feed the hydraulic turbine 3, which continues to rotate the fluid distributor 2 at substantially the same speed. As the feed of liquid to the hydraulic percussive mechanism 1 is cut off, the hydraulic turbine 3 rotates at a slower rate, the non-return valve 17 opens, and the hydraulic motor 4 starts to convey the liquid to the hydraulic turbine 3. The hydraulic turbine continues to rotate the fluid distributor 2 at low rpm until feeding of the liquid to the hydraulic percussive mechanism 1 is resumed. As the valve 7 terminates the rotation of the drill tool 5, the liquid flows from the pressure line 9 along the discharge line 15 through the flow governor 14 to the hydraulic turbine causing it to rotate. Therewith, the hydraulic turbine 3 rotates continuously, whereas the hydraulic percussive mechanism 1 can be actuated at any point in time by feeding the liquid to the pressure line 10 to be thereby capable of executing percussive action independently from the hydraulic motor 4 for rotating the drill tool. The frequency of impacts delivered by the percussive mechanism 1 is controlled by varying the rotational speed of the fluid distributor 2 by means of the flow throttling valve 18. After closing of the non-return valve 17 the hydraulic turbine 3 is fed only with the liquid spent in the percussive mechanism 1 to rotate the fluid distributor 2 at the maximum rate and result in the highest frequency of impacts delivered by the hammer of the hydraulic percussive mechanism 1. In order to reduce the frequency of impacts, it is necessary to change the rotational speed of the fluid distributor 2, which is attained by controlling the throttling valve 18. When opening the throttling valve 18, the liquid is withdrawn from the discharge line 16 of the percussive mechanism 1, via the flow restrictors 18 and 8, to the discharge line 11. A reduction in the flow of liquid entering the hydraulic turbine 3 causes a lower rotational speed of the fluid distributor 2. With the throttling valve 18 fully open it is possible to attain the minimum frequency of impacts delivered by the hammer of the percussive mechanism 1 through reduced rate of rotation of the fluid distributor 2. For increasing the frequency of impacts it is necessary to close the throttling valve 18, whereby a smaller quantity of the liquid will flow to the discharge line 11 accompanied by an increase in the flow of liquid to the hydraulic turbine 3 causing a higher rotational speed of the hydraulic turbine 3. Therefore, after starting the hydraulic turbine 3 it receives an extra flow of the liquid spent in the hydraulic percussive mechanism 1 to result in closing of the non-return valve 17 and increasing of the rotational speed of the fluid distributor 2. Conversely, by controlling the throttling valve 18 it is possible to attain redistribution of the liquid from the discharge of the percussive mechanism 1 to the discharge line 11 and hydraulic turbine 3 and thereby change the frequency of impacts delivered by the hammer of the percussive mechanism 1.

The hydraulic drilling machine having a drive for rotating the fluid distributor in the form of a reaction turbine 19 (FIG. 2) operates in the following manner.

Liquid is conveyed to the hydraulic accumulator 12 and to the annular discharge cavity 22, and therefrom along the axial passages 23 to the working chamber 21 of the hydraulic turbine 3. From the working chamber 21 of the hydraulic turbine 3 the liquid passes through the tangential holes 27 causing the hydraulic turbine to rotate by virtue of a jet of liquid escaping from the working chamber 21 through the tangential holes 27 to the interior 28. Then the liquid flows from the interior 28 to the discharge line 30.

Thanks to the reactive thrust of the liquid escaping through the tangential holes 27, the hydraulic turbine rotates and causes rotation of the fluid distributor 2. While rotating, the fluid distributor 2 acts to alternately communicate by its longitudinal grooves 31 and 32 the work stroke chamber 33 of the hammer 26 with the annular discharge cavity 22 and pressure cavity 24.

When the longitudinal groove 32 of the hydraulic fluid distributor 2 communicates the work stroke chamber 33 with the annular discharge cavity 22, the hammer 26 executes a return stroke because the return stroke chamber 25 of the hammer 26 continuously communicates with the pressure line 10. The hammer 26 forces the liquid from the work stroke chamber 33 through the longitudinal grooves 32 of the fluid distributor 2 to the annular cavity 22 and to the hydraulic accumulator 12. During this procedure the hydraulic accumulator 12 is charged. Then the liquid is conveyed from the work stroke chamber 33 through the axial passages 23 to the working chamber 21 of the reaction hydraulic turbine 19. Since the tangential holes 27 passed earlier only the liquid fed to the discharge line 16 of the rotary fluid distributor, now they convey also the liquid spent in the hydraulic percussive mechanism 1 to result in an increase in the rotational speed of the hydraulic turbine. Rotational speed of the fluid distributor 2 grows accordingly. When the longitudinal groove 31 of the fluid distributor 2 communicates the work stroke chamber 33 with the annular pressure cavity 24, the hammer 26 executes work stroke by virtue of a difference in the cross section of the hammer 26 in the work and return stroke chambers 33 and 25. A difference in the forces acting on the hammer initiates a work stroke of the hammer 26. After the fluid distributor 2 switches the hammer 26 to the working stroke, in the course of the work stroke, and prior to switching the hammer 26 to the return stroke no liquid is fed to the hydraulic turbine 19 from the hydraulic percussive mechanism 1, although it maintains its rate of rotation, as the hydraulic accumulator 12 discharges the liquid feeding the hydraulic turbine. Afte the hammer 26 has executed the work stroke, the fluid distributor 2 rotates for the longitudinal groove 32 to communicate the work stroke chamber 33 with the annular discharge chamber 22. The hammer 26 executes a return stroke, and again the hammer 26 forces the liquid from the work stroke chamber 33 to the annular discharge cavity 22 charging the hydraulic accumulator 12, and then the liquid flows through the axial passages 23 to the working chamber 21 of the hydraulic turbine 3. At this point the cycle is terminated to be again recommenced.

In view of the aforedescribed, the proposed hydraulic drilling machine has the following advantages versus the prototype machine:

- a higher efficiency through using a joint flow of liquid from the hydraulic percussive mechanism, accumulator, and hydraulic motor rotating the drill tool to rotate the hydraulic turbine; and
- expanded functional capabilities of the hydraulic percussive mechanism when controlling the frequency of percussive action with guaranteed starting of the hydraulic turbine in different direction of rotation or stops in rotation of the drill tool thanks to the liquid conveyed from the valve through the flow governor to the hydraulic turbine by accommodating the flow restrictor in the discharge line.

The proposed hydraulic drilling machine can be used for making blast holes in slopes, mines and quarries, as well as for working adits and driving tunnels.

We claim:

1. A hydraulic drilling machine comprising a drill tool, a hydraulic motor for rotating the drill tool connected thereto through a reduction gear, and having pressure and discharge lines, and a hydraulic percussive mechanism having pressure and discharge lines connected to this mechanism via a rotatable fluid distributor, and a drive for rotating the fluid distributor, the machine further comprising a fluid flow governor made up of a non-return valve and a flow throttling valve, the inlet of the flow governor being connected to a discharge line of the hydraulic motor for rotating the drill tool through a control slide valve built into the discharge line, and with the discharge line of the hydraulic motor through a flow restrictor, whereas the outlet of the flow governor is connected to the discharge line of the hydraulic percussive mechanism and to the inlet of the drive for rotating the fluid distributor, said drive being in the form of a hydraulic turbine, a hydraulic accumulator being provided in the discharge line of the hydraulic percussive mechanism.

2. A hydraulic drilling machine as claimed in claim 1, wherein the hydraulic turbine is a reaction turbine secured at a rotating element of the fluid distributor, a working chamber of the hydraulic turbine communicating with a discharge cavity of the rotary fluid distributor via axial passages made therein, the discharge cavity of the rotary fluid distributor continuously communicating with the hydraulic accumulator.

* * * * *